US005980022A

United States Patent [19]

Takagi

[11] Patent Number: 5,980,022

[45] **Date of Patent: *Nov. 9, 1999**

[54] IMAGE FORMING APPARATUS HAVING TONER FLOW CONTROL WHICH SHIELDS EXTENDED PORTION OF CONTROL ELECTRODES FROM TONER CARRYING MECHANISM

[75] Inventor: Osamu Takagi, Nagoya, Japan

[73] Assignee: Brother Kogyo Kabushiki Kaisha, Nagoya, Japan

[ * ] Notice: This patent is subject to a terminal disclaimer.

[21] Appl. No.: 08/418,295

[22] Filed: Apr. 7, 1995

[30] Foreign Application Priority Data

May 26, 1994 [JP] Japan ..... 6-112888

[51] Int. Cl.[6] ..... B41J 2/06

[52] U.S. Cl. ..... 347/55

[58] Field of Search ..... 347/55, 141, 151, 347/112, 147; 355/261, 262

[56] References Cited

U.S. PATENT DOCUMENTS

| | | | |
|---|---|---|---|
| 3,689,935 | 9/1972 | Pressman et al. | 347/55 |
| 4,743,926 | 5/1988 | Schmidlin et al. | 347/55 |
| 4,755,837 | 7/1988 | Schmidlin et al. | 347/55 |
| 4,780,733 | 10/1988 | Schmidlin | 347/55 |
| 4,814,796 | 3/1989 | Schmidlin | 347/55 |
| 4,912,489 | 3/1990 | Schmidlin | 347/55 |
| 5,036,341 | 7/1991 | Larsson | 347/55 |

FOREIGN PATENT DOCUMENTS

| | | |
|---|---|---|
| 0 587 366 A1 | 3/1994 | European Pat. Off. . |

*Primary Examiner*—Benjamin R. Fuller
*Assistant Examiner*—C. Dickens
*Attorney, Agent, or Firm*—Oliff & Berridge, PLC

[57] ABSTRACT

In an image forming apparatus, plural apertures are formed in a row in an insulation sheet of polyimide and control electrodes for the respective apertures are formed on the insulation sheet. The operation portion of each control electrode is directly contacted with the insulation sheet and the wire portion (non-operation portion) of the control electrode is disposed to face the insulation sheet through a second insulation sheet. A shield electrode is further provided between the two insulation sheets to prevent the occurrence of an electric field between the toner carry roller and the wire portions of the control electrodes.

7 Claims, 3 Drawing Sheets

IMAGE FORMING APPARATUS HAVING TONER FLOW CONTROL WHICH SHIELDS EXTENDED PORTION OF CONTROL ELECTRODES FROM TONER CARRYING MECHANISM

BACKGROUND OF THE INVENTION

1. Field of the Invention

The invention relates to an image forming apparatus which is suitably usable for a copying machine, a printer, a plotter, a facsimile, or similar printing apparatus.

2. Description of Related Art

A conventionally known image forming apparatus is disclosed in U.S. Pat. No. 3,689,935. The apparatus uses an electrode having plural opening portions (hereinafter referred to as "apertures") and a voltage is applied to the electrode in accordance with image data to control passage of toner particles through the apertures, whereby an image is formed on a supporter (image receiving medium) with the passed toner particles.

The image forming apparatus includes an aperture electrode unit comprising an insulating flat plate, a reference electrode formed continuously on one surface of the flat plate, plural control electrodes formed on the other surface of the flat plate are electrically insulated from one another, and at least one row of apertures are formed, with an aperture in correspondence with each control electrode, so as to penetrate through the flat plate, the reference electrode and the control electrodes; means for selectively applying a voltage across the reference electrode and the control electrodes; means for supplying charged toner particles so that the flow of the toner particles passed through the apertures is modulated in accordance with the applied voltage; and means for moving a supporter and the aperture electrode unit relative to one another to position the supporter in a particle flow passage.

Further, U.S. Pat. Nos. 4,743,926, 4,755,837, 4,780,733, and 4,814,796 disclose image forming apparatuses having an aperture electrode unit disposed so that control electrodes face a supporter and a reference electrode faces a toner supply side.

On the other hand, U.S. Pat. No. 4,912,489 discloses an aperture electrode unit disposed so that the reference electrode faces the supporter and the control electrodes face the toner supply side. In the specification of U.S. Pat. No. 4,912,489 it is described that a voltage to be applied to the control electrodes at an off-time can be reduced to about a quarter of that of the image forming apparatus as disclosed in the above U.S. patents.

The term "off-time" means a time when no toner particle is attached onto the supporter, that is, when a blank portion of an image is formed on the supporter and, conversely, the term "on-time" means a time when a toner image is formed on the supporter.

In the image forming apparatus as described above, a reference electrode is provided on one surface of the flat plate while plural control electrodes are provided on the other surface. An electric field for controlling movement of charged toner is formed by applying a prescribed voltage across the reference electrode and the control electrodes. Accordingly, in order to control the movement of the charged toner supplied to the vicinity of the aperture electrode unit from the toner supply means, a strong electric field must be formed between the reference electrode and the control electrodes. In order to form the strong electric field between the electrodes, a voltage supply means for applying a high voltage must be used so that the total manufacturing cost of the apparatus is expensive.

In order to solve this problem, there was proposed an image forming apparatus as disclosed in European Unexamined Patent Publication No. 587,366. This image forming apparatus includes an aperture electrode unit 101, as shown in FIG. 4, which is capable of controlling the movement of toner even using a low voltage. The aperture electrode unit 101 of the image forming apparatus comprises a flat plate 102 which is formed of an insulation member and has a thickness of 25 μm, plural apertures 106 each of which is formed in the flat plate 102 and has a diameter of about 40 μm, and control electrodes 104, a control electrode 104 being independently provided for each aperture 106 and having a thickness of 1 μm. Each control electrode 104 comprises an operation portion 104A, which is disposed in such a way as to surround the corresponding aperture 106, and a wire portion (non-operation portion) 104B, which is disposed in such a way as to extend from the aperture 106 to the end portion of the flat plate 102. The plural apertures 106 are provided in such a way as to penetrate through the flat plate 102 and the control electrodes 104 and are arranged in a row in the longitudinal direction of the flat plate 102.

The aperture electrode unit 101 is slightly pressed against a carry roller (not shown), so that it is brought into slight contact with the carry roller, and a voltage is applied across each of the control electrodes and the carry roller. When the aperture electrode unit 101 thus structured is used in the image forming apparatus, an electric field is formed between the control electrodes 104 and the carry roller (not shown) carrying charged toner thereon upon application of a control voltage to the control electrodes 104. As a result, toner flow (movement of the toner) occurs between the control electrodes 104 and the carry roller (not shown), and the toner on the carry roller passes through the apertures 106 and moves to a supporter side (not shown).

With this structure, the movement of the toner can be controlled with a far lower voltage as compared with the conventional image forming apparatus.

However, in this case the voltage is applied to the whole of the control electrodes 104 and, thus, the electric field is formed between the carry roller (not shown) and the wire portion 104B, which is not directly associated with the movement of the toner, so that the toner is electrostatically attracted and adheres to a part of the flat plate 102 which is located below the wire portion 104B. By this phenomenon, the toner adhering to the flat plate 102 is deposited between the control electrodes 104 and the carry roller, the flat plate 102 is pushed up by the deposited toner, and the distance between the carry roller (not shown) and the flat plate 102 is gradually increased. Therefore, the electric field for controlling the toner flow is gradually weakened, and the toner is not sufficiently moved to the supporter side, so that there occurs a problem that a image formed on the supporter is blurred.

Particularly when the wire portions 104B of the control electrodes 104, which are not associated with the toner movement, are disposed at the upstream side of the rotational direction of the carry roller (not shown), the following problem occurs. If the toner adheres to the flat plate 102 side below the wire portions 104B, the toner supply amount to the apertures 106 would be temporarily reduced by the amount of the toner adhering to the flat plate 102, when continuous dots are printed as an image on the supporter, so that the image formed on the supporter is blurred.

On the other hand, the electric field which is formed between the control electrodes 104 and the carry roller (not shown) by the control voltage, that is, the electric field for allowing the toner to pass through the apertures 106, and the electric field which causes the toner to adhere to the flat plate 102, extinguishes when a non-control voltage is applied to the control electrodes 104 to stop the occurrence of the toner flow (movement). As a result, the toner adhering to the flat plate 102 is released to return to and be fed by the toner carry roller. Accordingly, the toner carry amount on the toner carry roller is partially (locally) increased by the toner returning to the toner carry roller. Thus, the toner is nonuniformly carried on the surface of the toner carry roller (that is, unevenness of the toner amount occurs on the toner carry roller).

If the control voltage is applied to the control electrodes 104 to induce the toner flow when an area having a larger toner amount carried on the toner carry roller is located below the apertures 106, the toner supply becomes excessive, and the toner flow amount to the supporter side is excessively increased so that fog occurs in the image formed on the supporter. Furthermore, if the non-control voltage is applied to the control electrodes 104 when the larger toner amount area is located below the apertures 106, the force of the toner flow drives the toner to be emitted from the apertures 106. As a result, the toner adheres to a non-image portion on the supporter and high image quality cannot be obtained.

Lastly, if the toner repetitively adheres onto the surface of the flat plate in the vicinity of the control electrodes 104 of the flat plate 102 and the adhering toner repetitively returns to the toner carry roller as described above, the distance between the control electrodes 104 and the carry roller is varied so that the electric field for inducing the toner flow is not stabilized and the image quality is not stabilized.

SUMMARY OF THE INVENTION

An object of the invention is to provide an image forming apparatus which is capable of forming an image with high image quality by shielding the electric field formed between wire portions of control electrodes and the toner supply means, and which can be manufactured at a low cost.

In order to attain the above object, an image forming apparatus according to the invention, in which charged toner is controlled to pass through apertures by an aperture electrode unit having plural apertures to form an image on a supporter which is disposed at the opposite side of a toner supply source with respect to the aperture electrode unit, is characterized by including a first insulating sheet which is provided on one surface of the aperture electrode unit which faces the toner supply source, a plurality of control electrodes, a control electrode individually (sectionally) provided to each aperture, and shield means which is provided between the first insulating sheet and the wire portions of the respective control electrodes which exclude aperture-formed portions of the control electrodes and serves to shield an electric field formed between the wire portions of the control electrodes and the toner supply source.

Preferably, the shield means comprises a flat plate type of shield electrode, and a second insulation sheet is provided between the shield electrode and the wire portions of the control electrodes.

According to the image forming apparatus thus structured, the shield electrode provided between the wire portions of the plural control electrodes and the first insulation sheet shields the electric field formed between the wire portion of each control electrode and the toner supply source.

As is apparent from the foregoing, according to the image forming apparatus of the invention, since the shield electrode provided between the wire portions of the plural control electrodes and the first insulation sheet shields the electric field formed between the wire portion of each control electrode and the toner supply source, the image can be formed with high image quality and the cost of the apparatus can be reduced.

BRIEF DESCRIPTION OF THE DRAWINGS

Preferred embodiments of the invention will be described in detail with reference to the following figures wherein.

DETAILED DESCRIPTION OF THE PREFERRED EMBODIMENTS

Figure 1:
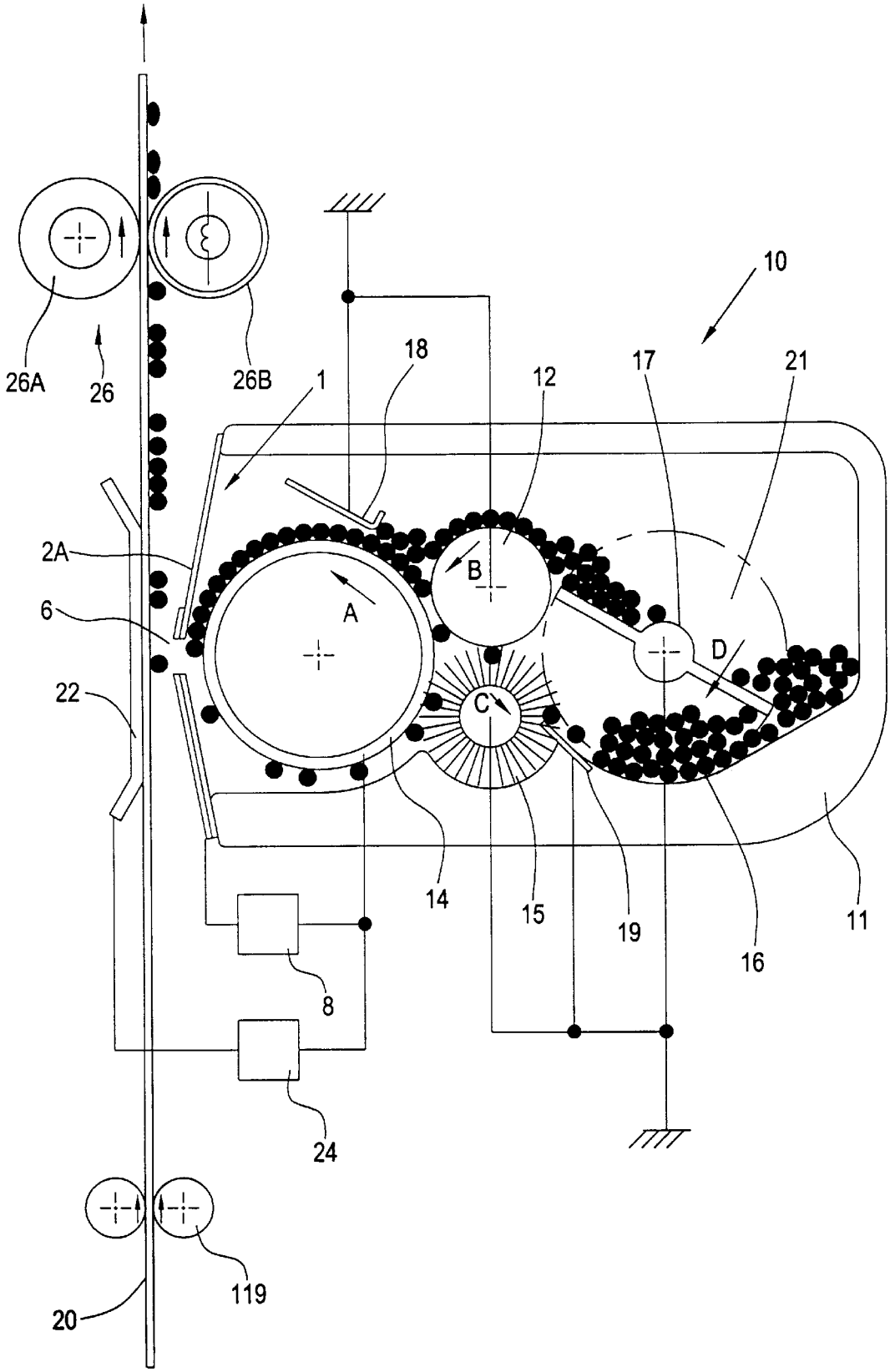
FIG. 1 is a cross-sectional view showing an image forming apparatus of an embodiment of the invention.

A preferred embodiment according to the invention will be described with reference to the accompanying drawings. FIG. 1 is a cross-sectional view showing an image forming apparatus of the embodiment. As shown in FIG. 1, a counter (back) electrode plate 22 is disposed at the left side of an aperture electrode 1 so as to be spaced from each other at an interval of 1 mm, whereby a supporter 20, inserted into the gap between the aperture electrode unit 1 and the counter electrode plate 22, can be guided through the gap. Furthermore, a toner supply device 10 is disposed along the longitudinal direction of the aperture electrode unit 1 at the right side of the aperture electrode unit 1, and a fixing device 26, having rollers 26A and 26B, is disposed at the downstream side of a feed direction of the supporter 20 which is guided by the counter electrode plate 22.

The toner supply device 10 comprises a toner case 11 which also serves as a housing for the whole apparatus, toner 16 stocked in a toner reservoir 21 in the toner case 11, a toner supply roller 12, a toner carry roller 14, a toner withdrawing roller 15, an agitator 17, a toner-layer restricting blade 18 and a toner withdrawing blade 19. The toner carry roller 14 carries the toner 16 thereon to feed the toner 16 toward the aperture electrode unit 1, and the toner supply roller 12 supplies the toner 16 to the toner carry roller 14. The toner supply device 10 containing the toner carry roller 14 constitutes a toner supply source of the invention. The toner withdrawing roller 15 comprises a stainless steel shaft around which cloth of nylon brush is adhesively attached and it serves to peel off the toner 16 remaining on the toner carry roller 14. The agitator 17 serves to mix and agitate unused toner 16 and the toner 16 withdrawn by the toner withdrawing roller 15.

The toner supply roller 12, the toner carry roller 14, the toner withdrawing roller 15 and the agitator 17 are supported by the toner case 11 so as to be rotatable in the directions as indicated by arrows A, B, C and D of FIG. 1, respectively. Furthermore, both of the toner carry roller 14 and the toner supply roller 12 and both of the toner carry roller 14 and the toner withdrawing roller 15 are respectively disposed in contact with each other.

The toner-layer restricting blade 18 is pressed against the toner carry roller 14 and serves to adjust the toner amount on the toner carry roller 14 so that the toner amount is uniform over the surface of the toner carry roller 14 and also to uniformly charge the toner 16 on the toner carry roller 14. The toner withdrawing blade 19 is disposed so as to be brought into contact with the tip of the brush of the toner withdrawing roller 15. Upon rotation of the toner withdrawing roller 15, the toner 16 adhering to the brush is peeled off by the blade 19 and falls into the toner reservoir 21.

Figure 2A:
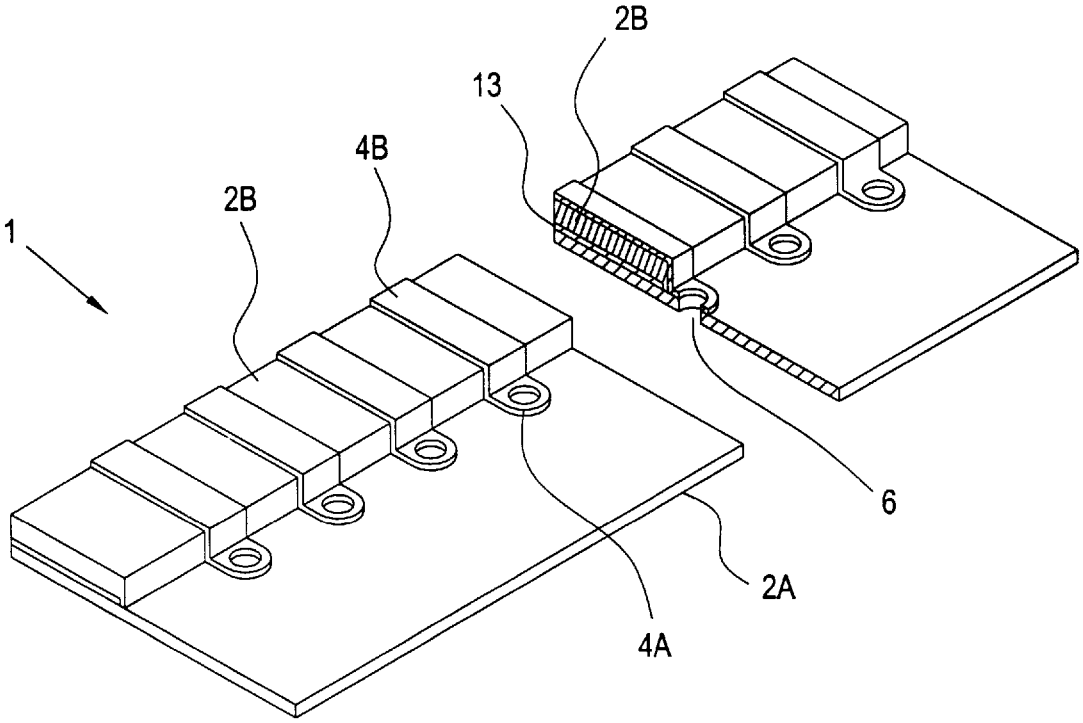
FIG. 2A is a perspective view showing an embodiment of an aperture electrode unit used in the image forming apparatus.
Figure 2B:
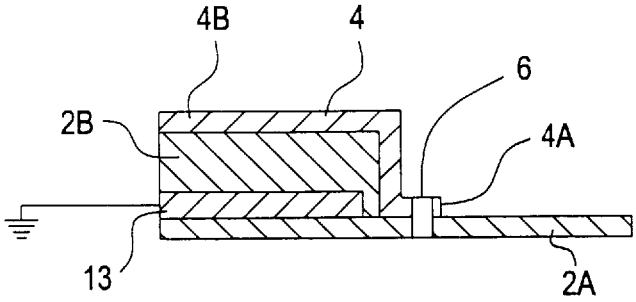
FIG. 2B is a cross-sectional view showing the aperture electrode unit used in the image forming apparatus.

As shown in FIGS. 2A and 2B, the aperture electrode unit 1 of this embodiment comprises a first insulation sheet 2A of polyimide and 50 $\mu$m thickness, plural apertures 6 of 40 $\mu$m diameter which are formed in a row in the longitudinal direction of the insulation sheet 2A, and control electrode 4 of 1 $\mu$m thickness, a control electrode 4 is formed in the vicinity of each aperture 6 on the surface of insulation sheet 2A. An operation portion 4A of each control electrode 4 is directly connected to the insulation sheet 2A and a two-layered structure, in which a second insulation sheet 2B is interposed between the insulation sheet 2A and a wire portion 4B (non-operation portion) of each control electrode 4, is provided. The lower portion of the wire portion 4B which is mounted on a surface of second insulation sheet 2B. A shield electrode 13 is further provided between the first insulation sheet 2A and the second insulation sheet 2B. The shield electrode 13 is formed of a conductive member and is grounded.

The insulation sheet 2B may be formed of the same material as the insulation sheet 2A, or it may be formed of different insulation material, such as resin or ceramics. For example, the insulation sheet 2A and the insulation sheet 2B may be formed of a vinyl chloride resin, such as polyvinyl dichloride, styrene resin, AS resin, ABS resin, methacrylic resin, methacrylic/styrene copolymer, polyethylene, ethylene/vinyl acetate copolymer, polypropylene, polypropylene copolymer, polypropylene/glass fiber, polypropylene inactive material, ionomer resin, polytetrafluoroethylene, polytetrafluoroethylene/glass fiber, polycarbonate, polycarbonate/glass fiber, polyphenylene/oxide/glass fiber, methyl pentene resin, or chlorinated polyether resin.

When the aperture electrode unit thus structured is applied to the image forming apparatus as described above, any electric field which may be formed between the wire portions 4B and the toner carry roller 14 is shielded by the shield electrode 13 so that the toner 16 can be prevented from adhering to the insulation sheet 2A. Therefore, blurring of the image and unevenness of print density can be prevented.

Figure 2C:
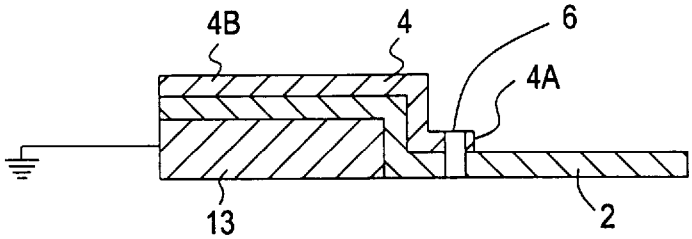
FIG. 2C is a cross-sectional view of another embodiment of the aperture electrode unit.

An aperture electrode shown in FIG. 2C may be used as an alternative embodiment of the aperture electrode unit 1 in the image forming apparatus. In the aperture electrode unit shown in FIG. 2C, the insulation sheet 2 comprises one body obtained by connecting the insulation sheets 2A and 2B as described above to each other. In this case, the control electrodes 4 are provided on the surface of the insulation sheet 2, that faces the counter electrode 22, and the shield electrode 13 is provided on the other surface of the insulation sheet 2, that faces the toner carry roller 14 and is located at the wire portions 4B of the control electrodes 4.

The aperture electrode unit 1 is pressed against the toner carry roller 14 at the position corresponding to the apertures 6 of the insulation sheet 2A in a state where the control electrodes 4 are confronted to the supporter 20 as shown in FIG. 1. Next, the positional relationship between the apertures 6 of the aperture electrode unit 1 and the toner carry roller 14 will be described in detail.

Figure 3:
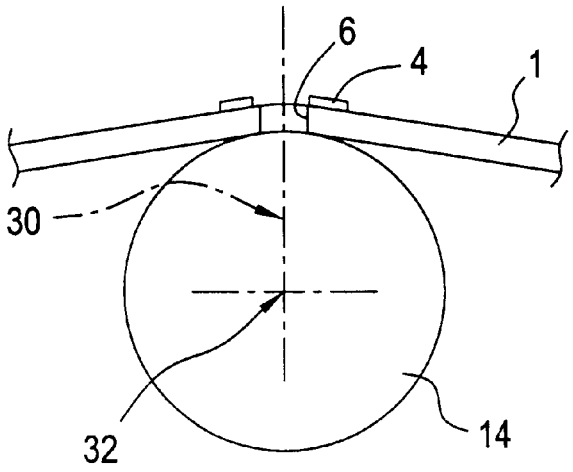
FIG. 3 is a schematic view showing an arrangement of the aperture electrode unit and a carry roller.
Figure 4:
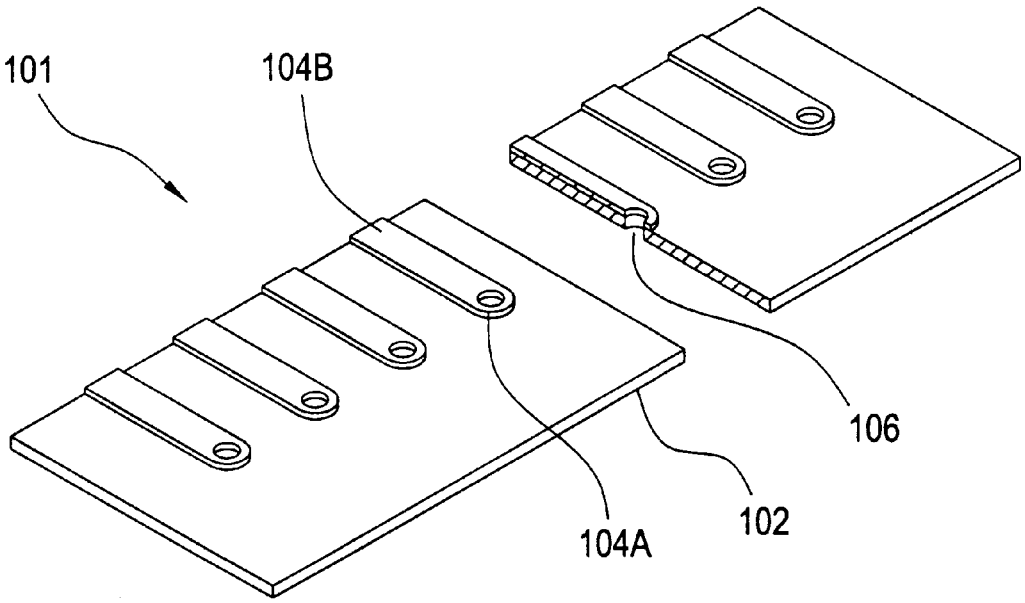
Fig. 4 RELATED ART
FIG. 4 is a perspective view showing an aperture electrode unit used in a conventional image forming apparatus.

As shown in FIG. 3, each aperture 6 is disposed so that the center line 30 thereof passes through the uppermost portion of the peripheral surface of the toner carry roller 14 and the center axis 32 of the toner carry roller 14. With this arrangement, each aperture 6 is disposed uniformly (symmetrically) to the right and left sides thereof with respect to the uppermost portion of the peripheral surface of the toner carry roller 14, so that the distribution of the toner 16 passing through each aperture 6 can be made uniform over the entire area in each aperture 6. Further, the wall surface of each aperture 6 and the flight direction of the toner 16 are parallel to each other, so that the toner 16 stably flies toward the supporter 20.

The aperture electrode unit 1 itself is pressed against the toner carry roller 14 so as to be bent to the right and left sides thereof at the same angle with each aperture at the center thereof, as shown in FIG. 3, so that the contact area between the aperture electrode unit 1 and the toner carry roller 14 can be increased. In addition, the lower peripheral portion of each aperture 6 can be uniformly pressed against the toner carry roller at the right and left sides thereof, so that the unevenness of the density of the toner can be suppressed at maximum.

A control voltage applying circuit 8 is connected between the control electrodes 4 and the toner carry roller 14. It is designed to apply a voltage of 0V or +50V to the control electrodes 4 on the basis of an image signal. Further, a DC power source 24 is connected between the counter electrode plate 22 and the toner carry roller 14 and is designed to apply a voltage of +1 KV to the counter electrode plate 22.

Next, the operation of the image forming apparatus thus structured will be described.

First, upon rotation of the toner carry roller 14 and the toner supply roller 12 in the directions as indicated by arrows A and B in FIG. 1, the toner 16 which is fed from the toner supply roller 12 is rubbed against the toner carry roller 14 and carried on the toner carry roller 14 while negatively charged. The toner 16 carried on the toner carry roller 14 is thinned and further negatively charged by the toner layer-restricting blade 18 and is then fed toward the aperture electrode unit 1 by the rotation of the toner carry roller 14. Thereafter, the toner 16 on the toner carry roller 14 is fed to the lower side of each aperture 6 while rubbed against the insulation sheet 2 of the aperture electrode unit 1.

In accordance with the image signal, a voltage of +50 V is applied to the control electrodes 4 corresponding to an image-forming portion from the control voltage applying circuit 8. As a result, an electric field directed from the control electrodes 4 to the toner carry roller 14 is formed in the neighborhood of the apertures 6 for the image-forming portion due to the potential difference between the control electrodes 4 and the toner carry roller 14. As a result of the electric field, the negatively charged toner 16 is electrostatically attracted to the higher potential portion so that the toner 16 passes from the surface of the toner carry roller 14 through the apertures 6 and is drawn out to the control electrode side. The drawn-out toner 16 is further attracted to the supporter 20, by an electric field which is formed between the supporter 20 and the aperture electrode unit 1 by the voltage applied to the back electrode plate 22, and deposited onto the supporter 20 to thereby form picture elements on the supporter 20.

On the other hand, a voltage of 0V is applied to the control electrodes 4 corresponding to a non-image forming portion, so that no electric field is formed between the toner carry roller 14 and the control electrode 4. Therefore, the toner 16 on the toner carry roller 14 is not electrostatically attracted and no toner 16 passes through the non-image apertures 6.

The supporter 20 is fed in a direction perpendicular to the aperture array by feed roller 119, the distance corresponding to one picture element while one array of picture elements are formed on the surface of the supporter 20. By repeating the above process, a toner image is formed on the whole surface of the supporter 20 and then the toner image thus formed is fixed onto the supporter 20 by the fixing device 26. In the above embodiment, the control voltage for the apertures corresponding to the non-image forming portion is set to 0V, however, it may be set to a negative voltage. In this case, an image having less fog can be obtained.

If insulating toner is used in the image forming apparatus of this embodiment, insulation is kept between the toner carry roller 14 and the control electrodes 4, and the apertures 6 can be prevented from being broken down.

As described above, in the image forming apparatus of this embodiment, the electric field which is formed between the wire portions 4B of the control electrodes 4 of the aperture electrode unit 1 and the toner carry roller 14 is shielded by the shield electrode 13, so that the toner 16 carried on the toner carry roller 14 can be prevented from repetitively adhering to the insulation sheet 2A and also the toner 16 adhering to the insulation sheet 2A can be prevented from repetitively returning to the toner carry roller 14. Therefore, the positional relationship between the toner carry roller 14 and the aperture electrode unit 1 is stabilized and the image can be stably formed on the supporter 20 at all times.

The control electric field created by the control electrodes 4 is formed on the carry roller 14 below the apertures 6 and inside of the apertures 6. That is, the toner 16 is carried on the toner carry roller 14 so that the control electric field directly acts on the toner 16. Even when the toner 16 partially invades into the apertures corresponding to the non-image forming portion, due to a mechanical force which is caused through sliding between the toner 16 and the aperture electrode unit 1, the toner 16 can be controlled not to pass through the apertures 6 by the electric field which is formed within the apertures 6 by applying a negative voltage to the control electrodes 4. Accordingly, the control performance of the toner 16 is excellent.

Furthermore, since the toner carry roller 14 and the aperture electrode 1 are disposed so as to confront each other through the toner layer, these elements can be disposed at a relatively short distance, so that the control voltage can be set to a low value and a low-price driving element can be used.

The insulation sheet 2A of the aperture electrode unit 1 is disposed so as to confront the toner carry roller 14. Therefore, even if no toner exists on the toner carry roller 14 due to failure of the toner supply device 10, the control electrodes 4 and the toner carry roller 14 can be prevented from being contacted with each other and thus electrically short-circuited precluding damage to the driving element.

Still further, the aperture electrode unit 1 and the toner 16 on the toner carry roller 14 are contacted with each other at the inlet portions of the apertures 6, the toner 16 deposited at the inlet portions of the apertures 6 is pushed out by the toner 16 which is successively supplied from the toner carry roller 14. Therefore, the toner 16 can be prevented from being deposited in the vicinity of the apertures 6 so that the apertures 6 are not clogged with the toner 16.

The invention is not limited to the above embodiments and various modifications can be made without departing from the subject matter of the invention.

For example, in this embodiment, the wire portions of the control electrodes 4 are provided at only one side of the aperture electrode unit 1, however, these portions may be provided at both sides of the aperture electrode unit 1. In such a case, the shield electrode 13 and the insulation sheet 2B of the aperture electrode unit 1 are required to be provided at both sides of the aperture electrode unit 1.

Further, in the above embodiment, the aperture electrode unit 1 is used as the toner flow control means. However, a mesh-shaped electrode unit as disclosed in U.S. Pat. No. 5,036,341 may be used as the toner flow control means.

What is claimed is:

1. An image forming apparatus for forming an image on a recording medium with charged toner particles, comprising:

toner carrying means for carrying and supplying charged toner particles;

a back electrode;

toner flow control means provided between said toner carrying means and said back electrode for controlling a flow of the charged toner particles in a toner flow direction such that the charged toner particles pass through the toner flow control means, said toner flow control means including:

a plurality of toner flow control apertures for controlling the flow of the charged toner particles in the toner flow direction such that the charged toner particles pass through said toner flow control apertures for forming the image on the recording medium which is disposed between said toner flow control means and said back electrode;

a plurality of control electrodes, a control electrode being provided adjacent to each flow control aperture of the flow control apertures, each control electrode of said plurality of control electrodes having an operation portion promimal to the flow of charged toner particles in the toner flow direction and an extended portion distal to the flow of charged toner particles in the toner flow direction;

an insulating sheet disposed between the plurality of control electrodes and the toner carrying means; and shield means for preventing an electric field from forming between the extended portion of each control electrode of the plurality of control electrodes and said toner carrying means, the shield means disposed between the insulating sheet and the toner carrying means, the shield means spaced from the operation portion of each control electrode of the plurality of control electrodes in a direction perpendicular to the flow of charged toner particles in the toner flow direction.

2. The image forming apparatus as claimed in claim 1, wherein said shield means is formed of a conductive material and is grounded.

3. The image forming apparatus as claimed in claim 1, wherein the toner flow control means further includes an insulating sheet provided on said shield means facing said toner carrying means.

4. An electrode apparatus for use with toner carrying means for carrying and supplying charged toner particles of an image forming apparatus, comprising:

an insulation member, wherein said insulation member includes a first insulation member and a second insulation member, the first insulation member defining an aperture having an axis;

a plurality of control electrodes disposed on said insulation member, each control electrode of said plurality of control electrodes having an operation portion around the aperture defined by the first insulation member, and a wire portion extending from said operation portion substantially to an edge of said second insulation member; and a shield member for preventing an electric field from forming between the wire portion of each control electrode of the plurality of control electrodes and the toner carrying means, the shield member disposed between the second insulation member and the toner carrying means, the shield member spaced from the operation portion of each control electrode of the plurality of control electrodes in a direction perpendicular to the axis of the aperture defined by the first insulation member.

5. The apparatus as claimed in claim 4, wherein said operation portion of said plurality of control electrodes are on a surface of the first insulation member, said second insulation member is mounted to said first insulation member and said wire portions of said plurality of control electrodes are on a surface of said second insulation member and said shield member is mounted between said first insulation member and said second insulation member.

6. The apparatus electrode as claimed in claim 4, wherein said shield member is mounted to another surface of said insulation member.

7. The elective apparatus as claimed in claim 4, wherein said shield member is formed of a conductive material and is grounded.

* * * * *